US006019403A

United States Patent [19]

Corbett

[11] Patent Number: 6,019,403

[45] Date of Patent: Feb. 1, 2000

[54] WIRE ROPE SPREADER

[76] Inventor: Gerald Lynn Corbett, 2540 Janin Way, Solvang, Calif. 93463

[21] Appl. No.: 09/108,887

[22] Filed: Jul. 1, 1998

[51] Int. Cl.[7] ..... B66C 1/12

[52] U.S. Cl. ..... 294/1.1; 294/74

[58] Field of Search ..... 294/1.1, 74, 81.1, 294/82.11, 82.13

[56] References Cited

U.S. PATENT DOCUMENTS

| | | | |
|---|---|---|---|
| 458,018 | 8/1891 | Curtis | 294/82.11 |
| 596,908 | 1/1898 | O'Neill | 294/82.13 |
| 2,889,166 | 6/1959 | Imhoff et al. | 294/74 |
| 3,502,364 | 3/1970 | Moore | 294/81.1 |
| 3,519,302 | 7/1970 | Orenstein | 294/74 |
| 4,239,272 | 12/1980 | Corbett | 294/74 |
| 4,249,474 | 2/1981 | Archer | 294/74 |

FOREIGN PATENT DOCUMENTS

| | | | |
|---|---|---|---|
| 867-840 | 9/1981 | U.S.S.R. | 294/74 |

*Primary Examiner*—Dean J. Kramer

[57] ABSTRACT

A Wire Rope Spreader comprised of a wire rope member with sufficient size to spread two steel wire rope slings to a safe and convenient work position. The preferred embodiment is attached directly to the hook of a crane or like mechanical hoist. The working slings will pass through each of the eyes at either end of the wire rope member and attach themselves to the hook of the crane or at the top lifting ring of the preferred embodiment.

8 Claims, 1 Drawing Sheet

WIRE ROPE SPREADER

BACKGROUND OF THE INVENTION

This invention relates to a wire rope spreader used for handling and spreading two steel wire rope construction slings from a common crane hook.

A steel wire rope sling will typically become kinked and deformed through normal use, thereby making the sling difficult to handle by the labor force. Additionally, one inherent characteristic of steel wire rope is that it will usually rotate and spin away from the preformed lay of the rope when loaded and spin in the opposite direction when unloaded. Consequently, when a pair of steel wire rope slings are attached to a common hoist or crane hook they will tend to wrap around each other. The above conditions will make rigging jobs very awkward and sometimes dangerous when performing both routine and non-routine rigging jobs. The time lost in handling and untangling the slings weighs heavily on the productivity of the labor force.

Standard rigging practices and methods will almost never directly address the problem of twisted and tangled slings. Certain futile attempts have been made to utilize conventional spreader bars to separate the slings, but they develop their own unique problems associated with extreme size, weight and rigid characteristics. Furthermore, lifting frames or spreader bars are indeed primarily engineered to accommodate certain carried materials/equipment for their structural integrity or for their safety and not for spreading slings. The actual benefit of having the slings hang free and unencumbered using a conventional lifting frame or rigid spreader bar is minimal.

A lifting device which features a method of separating the slings is illustrated in the patent to G. L. Corbett ("Applicant"), U.S. Pat. No. 4,239,272. The Corbett device does not deal with many of the various job situations primarily because it is a lifting device and the slings are included in the design, making it too restrictive and cumbersome to be practical in its use industry-wide. Additionally, the said device uses a predetermined size and length for the working slings; consequently, one may need to add slings and hardware to the device to suit his rigging requirements.

What is needed is a small, portable and convenient tool which is specifically suited to keep a pair of wire rope slings from becoming twisted or tangled while hanging from a mechanical hoist.

BRIEF SUMMARY OF THE INVENTION

The present invention is concerned with providing a spreading device for wire rope slings which is simple in concept and easy to install while making good economic sense. This invention's primary function is to keep the construction slings hanging free and positioned properly with very little effort by the labor force. The present invention is referred to as a "Wire Rope Spreader."

The Wire Rope Spreader will freely flex to any working angle of a pair of construction slings. The eyes of the preferred embodiment are at opposite ends and corners of the spreading member; therefore, any contact or chafing of the slings or parts thereof is eliminated when the wire rope spreader adjusts and bends to suit the correct angle of the working slings. Furthermore, having a wire rope spreader as a separate and unencumbered device in relation to the construction slings will greatly enhance this invention's adaptability and function.

The Wire Rope Spreader works to spread two construction slings in such a way that they will not get twisted around each other. The split eyes at either end of the wire rope member easily attach to the working slings of choice. The top lifting ring and attaching chain assembly will keep the wire rope spreader in the correct suspended working position from the hook of the most typical construction cranes.

It is the object of this invention to provide a tool which is practical in its concept. Therefore, it is lightweight and small in size for ease of handling and very adaptable to the work by integrating connectors or other like members that easily accommodate a selection of sling sizes through openings in the split eyes. The device will also easily attach to the hook of a crane by way of the lift ring provided at the top of the suspending chain.

The present invention is small enough to allow only one person to hand-carry and install the device on the hook of most construction cranes. Additionally, when in service it is the object of the present invention to spread the slings to a safe and convenient work position, thereby enhancing the performance of both the labor force and the desired rigging gear.

The principal object of this invention is to create a safer job in a highly productive work environment in the business of hoisting materials and equipment. These and other objects, features, and advantages will become more apparent after considering the following detailed descriptions taken in conjunction with the annexed drawings and appended claims.

BRIEF DESCRIPTION OF THE SEVERAL VIEWS OF THE INVENTION

DETAILED DESCRIPTION OF THE INVENTION

Figure 1:
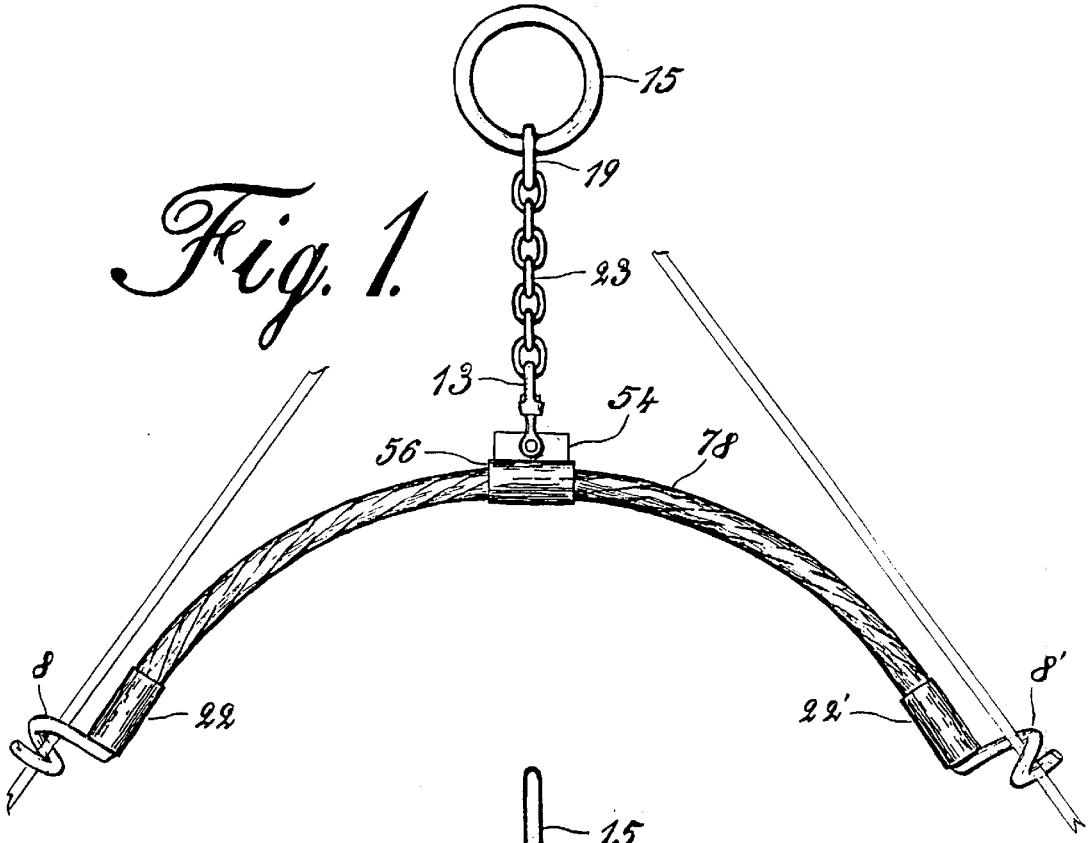
FIG. 1 is a typical front view of the Wire Rope Spreader incorporating the preferred embodiment of the invention, as it would appear hanging freely suspended from a lifting device. The drawing also illustrates the location of the two slings passing through the split ring eyes of the preferred embodiment.

Referring now to the drawings in which like reference numbers refer to like structural components in the two separate views, there is shown a Wire Rope Spreader according to the invention including a lifting ring (15), a shackle or coupling link (19) connecting the chain assembly (23) to the top lifting ring (15). A chain swivel (13) is fitted between the chain assembly and a plate link with a drilled hole referred to as a lug member (54) and welded to the sleeve or button (56) which is mechanically pressed onto the wire rope member (78). The pressed sleeve (56) is located in the middle of the wire rope member (78). Each of the two ends of the wire rope member (78) pass through a short pipe or tube sleeves (22 and 22') and are welded flush to the end of the pipe. The pipe sleeves (22 and 22') have curved round bar to form split ring eyes (8 and 8') which are welded to both the pipe ends (22 and 22') and to the ends of the wire rope member (78).

Figure 2:
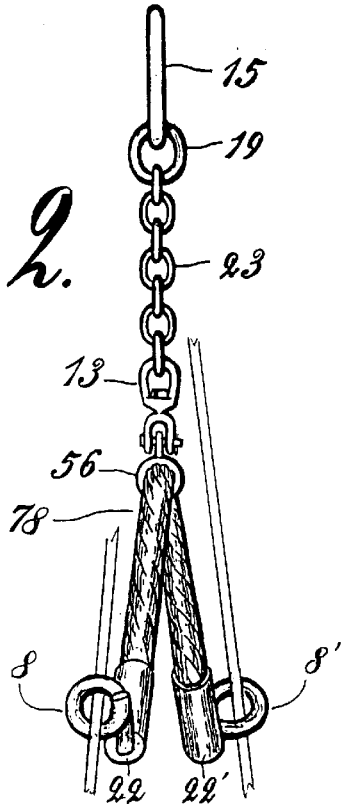
FIG. 2 is an end view of the Wire Rope Spreader including the slings passing through each of the eyes of the wire rope spreader.

In FIG. 2 the end view shows the position of the split ring eyes (8 and 8') at opposite ends and corners. As the wire rope spreader moves and flexes the split ring eyes (8 and 8') will keep the wire rope member (78) from fouling with the construction slings.

What I claim as my invention is:

1. A Wire Rope Spreader device utilized to spread two construction slings, comprised of a chain suspension assembly and a center sleeve and lug member holding a wire rope member fitted with split eye end connections designed to accommodate and hold unloaded construction slings at a safe and convenient work position and to further conform to the angle of attachment and allow the construction slings to straighten end-to-end when loaded.

2. A spreader as defined in claim 1 with a wire rope member sized and constructed to spread a pair of unloaded construction slings as desired and to flex to the angle of the loaded construction slings.

3. A spreader as defined in claim 2 with a chain assembly and chain swivel attached to the center sleeve and lug member of the wire rope member.

4. A spreader as defined in claim 3 with a shackle or similar coupling link connecting the chain assembly to a lifting ring.

5. A spreader as defined in claim 4 with the lifting ring designed to be received in a hook of a lift crane.

6. A spreader as defined in claim 5 with the lifting ring engineered for size and strength to carry both the wire rope spreader and the loaded or unloaded construction slings.

7. A spreader as defined in claim 1 with pipe or tube sleeves positioned over the ends of the wire rope member and rigidly attached.

8. A spreader as defined in claim 7 with split eye connections rigidly attached to the ends of the pipe or tube sleeves to easily receive, pass through and hold construction slings without undue restriction whether loaded or unloaded.

* * * * *